US012680711B2

(12) United States Patent
Mayer et al.

(10) Patent No.: US 12,680,711 B2
(45) Date of Patent: Jul. 14, 2026

(54) METHOD AND ASSEMBLY FOR COMPARING A ROOM TEMPERATURE WITH AIR-CONDITIONING PREFERENCES OF ROOM USERS

(71) Applicant: Siemens Aktiengesellschaft, Munich (DE)

(72) Inventors: Hermann Georg Mayer, Prien am Chiemsee (DE); Oliver Zechlin, Zug (CH)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 358 days.

(21) Appl. No.: 18/274,101

(22) PCT Filed: Jan. 20, 2022

(86) PCT No.: PCT/EP2022/051264
§ 371 (c)(1),
(2) Date: Jul. 25, 2023

(87) PCT Pub. No.: WO2022/161856
PCT Pub. Date: Aug. 4, 2022

(65) Prior Publication Data

US 2024/0410605 A1 Dec. 12, 2024

(30) Foreign Application Priority Data

Jan. 29, 2021 (EP) ..... 21154350

(51) Int. Cl.
*F24F 11/46* (2018.01)
*F24F 11/64* (2018.01)
(Continued)

(52) U.S. Cl.
CPC ..... *F24F 11/46* (2018.01); *F24F 11/64* (2018.01); *F24F 2110/10* (2018.01);
(Continued)

(58) Field of Classification Search
CPC ..... F24F 11/46; F24F 11/64; F24F 2110/10; F24F 2110/20; F24F 2120/10;
(Continued)

(56) References Cited

U.S. PATENT DOCUMENTS

2004/0260490 A1* 12/2004 Matsubayashi ..... H02J 3/003 702/60
2011/0038150 A1* 2/2011 Woodgate ..... G02B 19/0071 362/235
(Continued)

FOREIGN PATENT DOCUMENTS

CN 104134097 A 11/2014
CN 105190189 A 12/2015
(Continued)

OTHER PUBLICATIONS

Carreira, P., Costa, A.A., Mansur, V. and Arsenio, A., 2018. Can HVAC really learn from users? A simulation-based study on the effectiveness of voting for comfort and energy use optimization. Sustainable cities and society, 41, pp. 275-285. (Year: 2018).*
(Continued)

*Primary Examiner* — Alicia M. Choi
(74) *Attorney, Agent, or Firm* — Schmeiser Olsen PLLC

(57) ABSTRACT

Air-conditioning preferences of room users are read in order to compare a room temperature with air-conditioning preferences of the room users. Additionally, factors influencing the room temperature are detected and fed to a simulator in order to simulate the room temperature. A respective energy requirement for adapting the room temperature to the air-conditioning preferences is simulated by the simulator on
(Continued)

the basis of the detected influencing factors for different distributions of room users in the room. An energy-saving distribution of the room users is then ascertained on the basis of the simulated energy requirement. Position allotment information for room users is also output according to the energy-saving distribution.

16 Claims, 3 Drawing Sheets

(51) Int. Cl.
*F24F 110/10* (2018.01)
*F24F 110/20* (2018.01)
*F24F 120/10* (2018.01)
*F24F 130/10* (2018.01)

(52) U.S. Cl.
CPC ..... *F24F 2110/20* (2018.01); *F24F 2120/10* (2018.01); *F24F 2130/10* (2018.01)

(58) Field of Classification Search
CPC ..... F24F 2130/10; F24F 2120/12; F24F 2120/20; F24F 2130/20; F24F 11/30; F24F 11/58; F24F 11/72; G05B 15/02; G06Q 50/06
See application file for complete search history.

(56) References Cited

U.S. PATENT DOCUMENTS

2013/0310987 A1 11/2013 Sobek et al.
2014/0277765 A1* 9/2014 Karimi ..... G05B 15/02 700/276
2014/0316584 A1* 10/2014 Matsuoka ..... G05B 15/02 700/278
2015/0204556 A1 7/2015 Kusukame et al.
2015/0354848 A1 12/2015 Abel et al.
2016/0054023 A1 2/2016 Baker et al.
2016/0103475 A1* 4/2016 Lee ..... G05B 19/41885 700/291
2017/0288401 A1* 10/2017 Hummon ..... G05B 15/02
2017/0300599 A1 10/2017 Becerik-Gerber et al.
2018/0180314 A1* 6/2018 Brisette ..... G06N 7/01
2019/0324432 A1 10/2019 Cella et al.
2019/0360718 A1 11/2019 Ozaki
2020/0028703 A1* 1/2020 Homsi ..... H04L 12/413
2020/0143003 A1 5/2020 Klein et al.
2021/0011443 A1* 1/2021 Mcnamara ..... F24F 11/61
2025/0266711 A1* 8/2025 Ashman ..... H02J 13/00001

FOREIGN PATENT DOCUMENTS

CN 110073301 A 7/2019
DE 102010050726 A1 5/2012
DE 202020105811 U1 10/2020
EP 3651032 A1 5/2020
JP 2004144348 A 5/2004
JP 2010096430 A 4/2010
JP 2014206779 A 10/2014
JP 2015164844 A 9/2015
JP 2021006946 A 1/2021
KR 20190141935 A 12/2019

OTHER PUBLICATIONS

Zhao, J., Lasternas, B., Lam, K.P., Yun, R. and Loftness, V., 2014. Occupant behavior and schedule modeling for building energy simulation through office appliance power consumption data mining. Energy and buildings, 82, pp. 341-355. (Year: 2014).*
Zhang, S., Cheng, Y., Fang, Z., Huan, C. and Lin, Z., 2017. Optimization of room air temperature in stratum-ventilated rooms for both thermal comfort and energy saving. Applied Energy, 204, pp. 420-431. (Year: 2017).*
PCT International Search Report mailed Apr. 25, 2022 corresponding to PCT International Application No. PCT/EP2022/051264 filed Jan. 20, 2022.

* cited by examiner

METHOD AND ASSEMBLY FOR COMPARING A ROOM TEMPERATURE WITH AIR-CONDITIONING PREFERENCES OF ROOM USERS

CROSS-REFERENCE TO RELATED APPLICATIONS

This application claims priority to PCT Application No. PCT/EP2022/051264, having a filing date of Jan. 20, 2022, which claims priority to European Application No. 21154350.9, having a filing date of Jan. 29, 2021, the entire contents both of which are hereby incorporated by reference.

FIELD OF TECHNOLOGY

The following relates to a method and assembly for comparing a room temperature with air-conditioning preferences of room users.

BACKGROUND

For personal wellbeing at the workplace or in a place of residence, the setting of heating, air-conditioning system, ventilation or other systems for regulating the temperature, air humidity or other parameters of a room climate plays an essential role. In particular in open-plan offices with many people, it is often difficult to find an optimum setting of the climate control systems which meets the wishes of all the people in the room. This problem occurs in particular when the room climate is controlled centrally. However, even in the case of individual setting of local heating elements, cooling systems or ventilation systems, the individual requirements of the room users cannot often be completely met since even individual settings generally have an effect of the overall room climate. In addition, climate control systems often respond slowly, with the result that effects of settings can often be estimated with difficulty.

Recently, applications for mobile telephones are known which make it easier to find a consensus between different room users and also permit active monitoring of the room climate during times of absence. Settings found in this way do, however, often result in average results with which not all room users are satisfied. In addition, in many cases it is only possible for there to be an unsatisfactory response to changes to the arrival of people.

SUMMARY

An aspect relates to a method and an arrangement which enable a more efficient comparison of a room climate with climate preferences of room users.

In order to compare a room climate with climate preferences of room users, climate preferences of room users are input. In this case, the climate preferences can in particular relate to a temperature, air humidity, a ventilation, a brightness, a shading and/or an insolation of a room. Furthermore, physical influencing factors on the room climate are detected and fed into a simulator for simulating the room climate. Depending on the detected influencing factors, in each case one energy expenditure for an adaptation of the room climate to the climate preferences is simulated for different distributions of room users in the room by the simulator. Depending on the simulated energy expenditures, then an energy-saving distribution of the room users is determined.

Furthermore, in accordance with the energy-saving distribution, position assignment indications for room users are output.

In order to implement the method according to embodiments of the invention, an arrangement for comparing a room climate with climate preferences of room users, a computer program product (non-transitory computer readable storage medium having instructions, which when executed by a processor, perform actions) and a computer-readable, nonvolatile storage medium are provided.

In embodiments, the method according to the invention, the arrangement according to embodiments of the invention and the computer program product according to embodiments of the invention can in particular be implemented by one or more computers, one or more processors, application-specific integrated circuits (ASICs), digital signal processors (DSPs), a cloud infrastructure and/or so-called field-programmable gate arrays (FPGAs).

By a distribution of room users in the room, which is based on climate preferences, a room climate can be compared with climate preferences of the room users in an efficient and energy-saving manner. In many cases, a user comfort and therefore a user satisfaction can be considerably improved thereby.

In accordance with one embodiment of the invention, the room climate can be brought close to the climate preferences of room users distributed in accordance with the energy-saving distribution. This can take place in particular by active actuation of a heating system, an air-conditioning system, a ventilation system and/or a shading installation. Owing to an intrinsic inertia of the abovementioned climate control systems, they can be actuated already before the room users are actually in position or positioned in accordance with the energy-saving distribution.

In accordance with further embodiments of the invention, the following can be detected using sensors and/or in position-specific fashion as influencing factors: a temperature, air humidity, a ventilation, a brightness, a shading or other room climate data of the room; present, historical or predicted weather data; a room utilization behavior; and/or a window position, a door position or a position of a shading installation.

Alternatively, or in addition, historical room climate data and/or other historical influencing factors can also be detected and used. Consideration of the above-mentioned influencing factors generally enable a comparatively precise simulation of a room climate.

In accordance with an embodiment of the invention, a digital building model for the room can be input. The energy expenditures can then be simulated on the basis of the digital building model. Insofar as a room geometry and the properties of building elements of the room generally have a considerable influence on a room climate, the simulation can often be substantially simplified or improved by utilization of a digital building model.

In particular a semantic building model can be input as digital building model. In this case, a building element type of the semantic building model can be assigned to a building element type-specific simulator component, which can be initialized by an indication of the semantic building model on a building element of this building element type. As a result, the simulator can be modularized in many cases in an efficient manner, which generally simplifies a configuration or initialization of the simulator.

In accordance with a further embodiment of the invention, the room or a building plan of the room can be scanned, and, in dependence thereon, the digital building model can be generated.

Furthermore, a thermal image of the room can be captured, by which the simulator is calibrated. By such a calibration on the basis of real thermal data, an accuracy of the simulation, in particular a temperature or flow simulation, can generally be improved. Alternatively, or in addition, a present temperature distribution in the room can be determined or estimated for calibration of the simulator by temperature sensors, by a further simulation, on the basis of weather data, on the basis of data of a digital building model and/or on the basis of data of a building management system.

In accordance with a further embodiment of the invention, for the simulation of a respective energy expenditure, a discrepancy between a simulated room climate and the climate preferences of room users distributed in accordance with a respective distribution can be determined. Thus, an energy expenditure for an adaptation of the room climate which reduces or minimizes the discrepancy can be determined. In particular, a possibly minimal energy expenditure can be determined at which the resultant discrepancy does not exceed a preset tolerance value.

In accordance with an development of embodiments of the invention, the energy expenditures for variations in the climate preferences and/or the influencing factors can be simulated. Therefore, in each case one sensitivity value which quantifies a variation in the energy expenditures in the case of a variation in the climate preferences and/or the influencing factors can be determined for the distributions of the room users. The energy-saving distribution can then be determined depending on the determined sensitivity values. A lower sensitivity value in this case generally indicates a lower dependency of the energy expenditure on the climate preferences and/or the influencing factors. If influencing factors or climate preferences change, less sensitive distributions generally require smaller adaptations and are for this reason often to be desired over more sensitive distributions.

Furthermore, a fluctuation indication on a fluctuation to be expected in an occupancy of the room-by-room users can be input. The energy-saving distribution can then be determined depending on the fluctuation indication. On the basis of such a fluctuation indication, the simulation can be improved in many cases. The fluctuation indication can in particular include historical data on a room occupancy over the course of a day, week or year.

Furthermore, a present occupancy of the room-by-room users can be detected. The energy-saving distribution can then be determined depending on the present occupancy. Insofar as a distribution of climate preferences generally also depends on present room occupancy, with this information the simulation can generally be improved.

BRIEF DESCRIPTION

Some of the embodiments will be described in detail, with reference to the following figures, wherein like designations denote like members, wherein.

DETAILED DESCRIPTION

Figure 1:
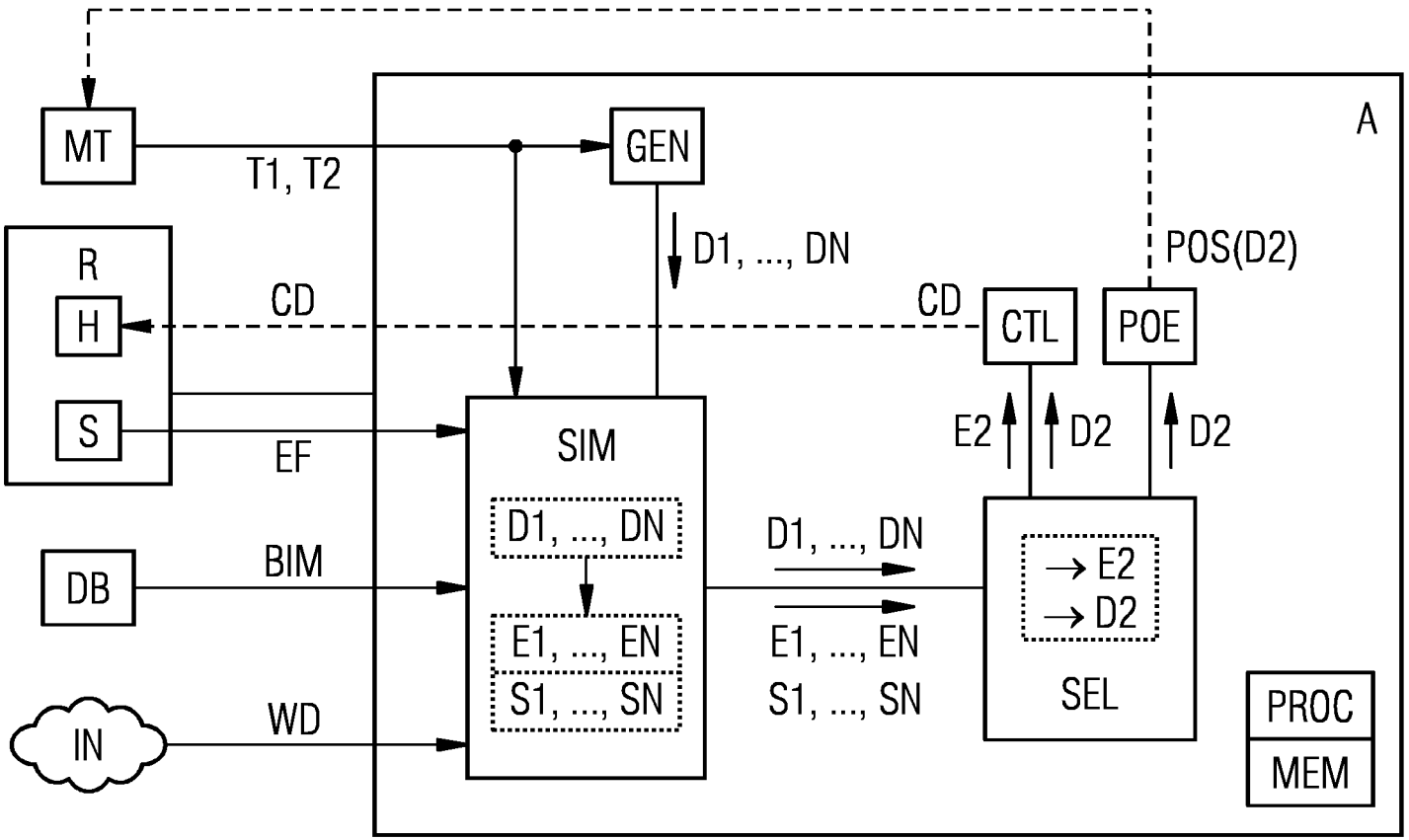
FIG. 1 shows an arrangement according to embodiments of the invention for comparing a room climate of a room with climate preferences of room users.

FIG. 1 shows a schematic illustration of an arrangement A according to embodiments of the invention for comparing a room climate of a room R with climate preferences of room users. The arrangement A is computer-controlled and has one or more processors PROC for implementing the method steps according to embodiments of the invention and one or more memories MEM for storing data to be processed by the arrangement A. The room R can be part of a building or of a structure, such as, for example, an open-plan office, a factory floor, a living space or another room whose room climate needs to be compared with climate preferences of room users. The room climate can include or relate to in particular a temperature, air humidity, a ventilation, a brightness, a shading and/or an insolation of the room R. The room climate is considered or detected in position-dependent fashion.

The room R has a closed-loop control system H for position-dependent closed-loop control of the room climate. The closed-loop control system H can comprise, for example, a heating system, an air-conditioning system, a ventilation system and/or a shading device.

Furthermore, the room R and/or its environment has a sensor system S which measures, in position-specific fashion or detects in some other way the physical influencing factors EF on the room climate. Furthermore, the sensor system S also detects a present occupancy of the room R by room users. In particular a temperature, air humidity, a ventilation, a brightness, a shading, an insolation, a window position, a door position, a position of a shading installation, a room utilization behavior or other room climate data of the room can be detected, in position-specific fashion, as influencing factors EF.

Predicted, present or historical weather data WD can be called up from the Internet IN, for example, as further physical influencing factors EF.

Whilst present room climate data or environmental data, such as, for example, an outside temperature, are detected by the sensor system S, historical room climate data and other influencing factors on the room climate can be input, for example, from a database DB.

In the present exemplary embodiment, in particular a digital, semantic building model BIM is input by the arrangement A from the database DB by which the room R is specified in structural terms. The semantic building model BIM is a so-called BIM (BIM: building information model) or another CAD model. The semantic building model BIM describes a geometry of the room R and a multiplicity of building elements thereof, such as, for example, walls, ceilings, floors, windows or doors in machine-readable form by a multiplicity of building element indications. Insofar as the geometry and the specific building elements of a room have a significant influence on the room climate thereof, the semantic building model BIM or indications contained therein can also be interpreted as physical influencing factors.

In accordance with embodiments of the invention, the room climate of the room R is intended to be compared with climate preferences of the room users by the arrangement A.

For this purpose, climate preferences of the room users are requested by the arrangement A via the users' mobile telephones MT and/or stored or historical climate preferences are input. The climate preferences can relate in particular to a temperature, air humidity, a ventilation, a brightness, a shading and/or an insolation of the room R.

In the present exemplary embodiment, only two temperature preferences T1 and T2 of the room users are considered as climate preferences for reasons of clarity. In this case, T1 could represent a temperature preference of "rather cool" and T2 could represent a temperature preference of "rather warm". The climate preferences T1 and T2 can be specified, for example, by temperature ranges.

In order to simulate the room climate of the room R, the arrangement A has a simulator SIM. For the purpose of this simulation, the semantic building model BIM, the physical influencing factors EF, the weather data WD and the climate preferences T1 and T2 are fed into the simulator SIM.

The simulator SIM can comprise specific simulator components, for example, for temperature simulation and/or for flow simulation. If appropriate, a temperature simulation of the simulator SIM can be calibrated on the basis of captured thermal images of the room R.

Furthermore, the simulator SIM can comprise in each case one building element type-specific simulator component for different building element types, such as, for example, windows, doors or walls of the semantic building model BIM. The simulator component can then be initialized by indications of the semantic building model BIM on specific building elements of the respective building element type. Thus, a respective wall of the room R can be coupled to a simulator component which specifically simulates a heat conduction through the wall and is initialized on the basis of indications on the thermal conductivity of the wall from the semantic building model BIM. In the above way, a configuration or initialization of simulation models or other simulator components of the simulator SIM can be automated or simplified in many cases.

The arrangement A furthermore has a generator GEN coupled to the simulator SIM for generating distributions D1, . . . , DN of room users in the room R. A respective distribution D1, . . . or DN can in this case be illustrated by a data structure which specifies the positions of room users in the room R.

The climate preferences, in this case T1 and T2, are fed into the generator GEN. On the basis of the climate preferences T1 and T2, distributions D1, . . . , DN are generated by the generator GEN with which room users with the same or similar climate preference are positioned next to one another. The generated distributions D1, . . . , DN are sent from the generator GEN to the simulator SIM.

The simulator SIM simulates in each case one energy expenditure E1, . . . or EN for an adaptation of the room climate to the climate preferences, in this case T1 and T2, distributed in accordance with D1, . . . or DN depending on the influencing factors EF for the sent distributions D1, . . . , DN. In this case, in order to determine the respective energy expenditure E1, . . . or EN, in each case discrepancies between different simulated room climates and the climate preferences of the room users distributed in accordance with D1, . . . or DN are determined. On the basis of the discrepancies, an energy expenditure E1, . . . or EN is determined for a respective distribution D1, . . . or DN by which a discrepancy is reduced or minimized. In an embodiment, in this case a tolerance value can be preset for the discrepancies. Therefore, a possibly minimal energy expenditure E1, . . . or EN can be determined at which the resultant discrepancy does not exceed the preset tolerance value.

The above energy expenditures E1, . . . , EN are in the present exemplary embodiment additionally simulated for a multiplicity of variations in the climate preferences, in this case T1 and T2, and/or the influencing factors EF. In this case, it is determined in each case for a respective distribution D1, . . . , or DN how severely a respective energy expenditure E1, . . . or EN varies in the case of a variation in the climate preferences T1, T2 and/or the influencing factors EF. The resultant variation in the respective energy expenditure E1, . . . or EN is quantified by a distribution-specific sensitivity value S1, . . . or SN. A lower sensitivity value S1, . . . or SN in this case indicates a lower dependence of the energy expenditure E1, . . . or EN on the climate preferences T1, T2 and/or the influencing factors EF. Distributions having lower sensitivity values are therefore more robust with respect to fluctuations in climate preferences and/or influencing factors. If influencing factors or climate preferences change, robust distributions generally require smaller adaptations and are for this reason often to be desired over less robust distributions.

The distributions D1, . . . , DN, the determined energy expenditures E1, . . . , EN and the determined sensitivity values S1, . . . , SN are sent from the simulator SIM to a selection module SEL which is coupled to the simulator SIM.

Furthermore, possibly the room occupancy which is presently measured by the sensor system S and/or a fluctuation indication on a fluctuation to be expected in the room occupancy is sent to the selection module SEL. The fluctuation indication can in this case be input from the database DB and can include in particular historical data on a room occupancy over the course of a day, week or year.

The selection module SEL is used for determining and selecting an energy-saving distribution of room users depending on the energy expenditures E1, . . . , EN and the sensitivity values S1, . . . , SN. In this case, a distribution with a comparatively low energy requirement and a comparatively low sensitivity value is selected. Possibly a weighted sum of a respective energy expenditure E1, . . . or EN and the respective assigned sensitivity value S1, . . . or SN can be formed. In this case, a distribution with the lowest weighted sum can be selected as energy-saving distribution.

In addition to the energy expenditures E1, . . . , EN and the sensitivity values S1, . . . , SN, the room occupancy and/or the fluctuation indication can also be taken into consideration in the selection of the energy-saving distribution. In particular, the fluctuation indication can be compared with the sensitivity values S1, . . . , SN. In dependence thereon, distributions which respond too sensitively to the fluctuations to be expected in accordance with their sensitivity value can be discarded for the selection.

It is assumed for the present exemplary embodiment that the distribution D2 at best meets the above criteria for an energy-saving distribution with little sensitivity and is therefore selected.

The selected energy-saving distribution D2 is sent from the selection module SEL to a position assignment device POE coupled thereto. The position assignment device POE determines, for a respective room user specified in the distribution D2, the individual position specified there for the user in the room R and includes this in a room user-individual position assignment indication POS. The respective position assignment indications POS are then sent from the position assignment device POE for each room user individually to the user's mobile telephone MT. Owing to the respective position assignment indication POS, an individually optimized position, for example in an open-plan office, is assigned to the respective room user.

Furthermore, the selected energy-saving distribution D2 and the associated energy expenditure E2 are sent from the selection module SEL to a control device CTL coupled thereto. The control device CTL is used for actuating and setting the closed-loop control system H depending on the selected energy-saving distribution D2 and the determined energy expenditure E2. For this purpose, corresponding control data CD are sent from the control device CTL to the closed-loop control system H. Insofar as such climate control systems often respond slowly, the closed-loop control system H can already be actuated before the room users are distributed or are being distributed corresponding to the selected distribution D2.

Owing to the distribution of room users in the room which is based on climate preferences and owing to the active control of the closed-loop control system H, a room climate can be compared in an efficient and energy-saving manner with climate preferences of the room users. In many cases, a user comfort and therefore a user satisfaction can thus be considerably improved.

Figure 2:
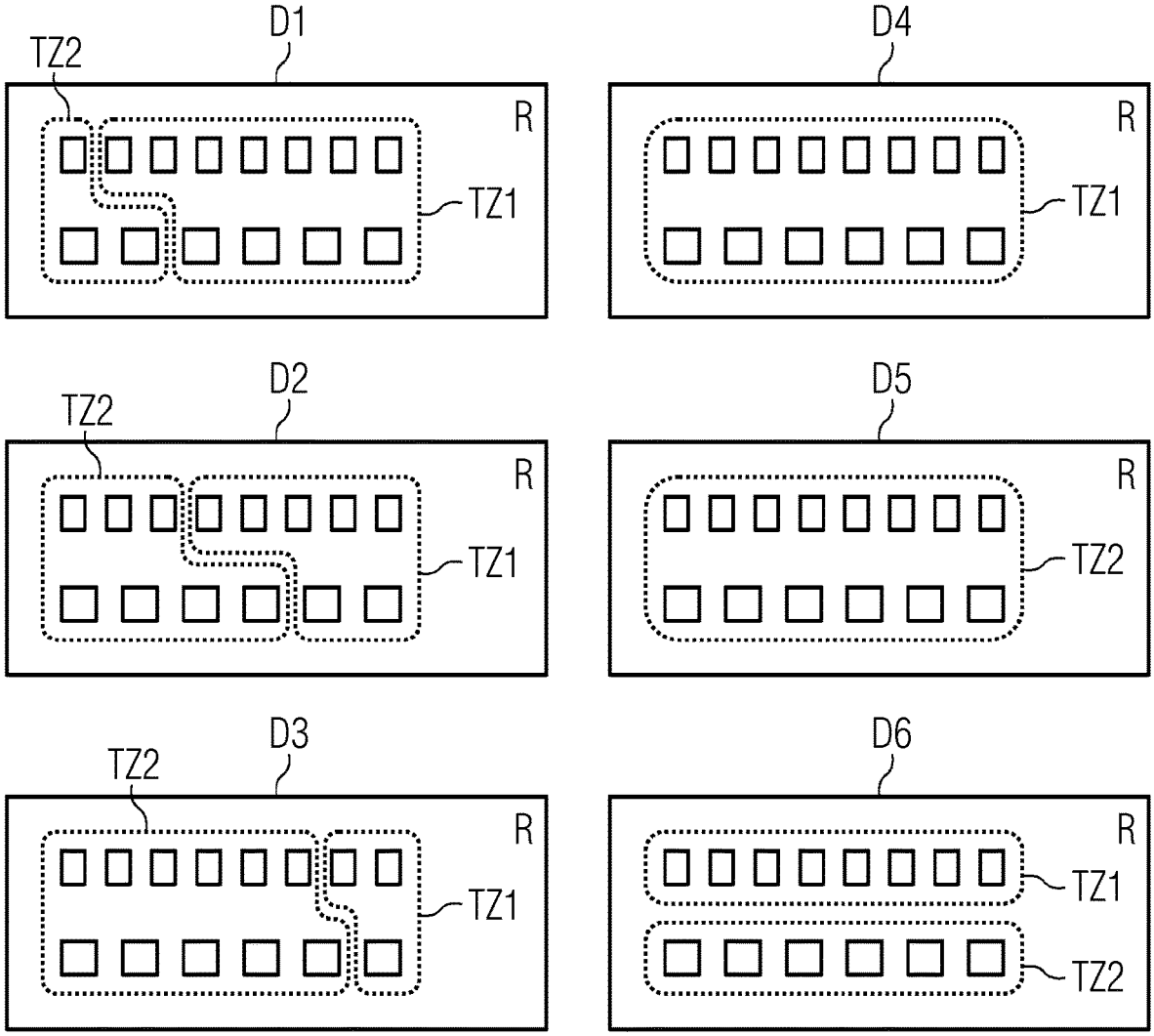
FIG. 2 shows different distributions of room users with different climate preferences.

FIG. 2 illustrates different distributions D1, . . . , D6 of room users in the room R who are grouped according to their different climate preferences, in this case T1 and T2. The distributions D1, . . . , D6 are in this case an exemplary selection from the above-described distributions D1, . . . , DN. Possible positions of the room users within the room R are illustrated in FIG. 2 by small rectangles.

By virtue of the grouping of the room users according to their climate preferences T1 and T2, the room R is subdivided into different room climate zones TZ1 and TZ2 for a respective distribution D1, . . . , D6. In this case, the room climate zone TZ1 is in each case that region of the room R in which room users with the climate preference T1 are located. Correspondingly, the room climate zone TZ2 is in each case that region of the room R in which room users with the climate preference T2 are located. The room climate zones TZ1 and TZ2 are marked in each case by a dotted line in FIG. 2. In the present exemplary embodiment, the room climate zones TZ1 and TZ2 are temperature zones.

As already mentioned above, the simulator SIM simulates, for each distribution D1, . . . , D6 in each case that energy expenditure E1, . . . , E6 which is required in order to create the corresponding room climate in the respective room climate zones TZ1 and TZ2.

The unified distributions D4 and D5 are in the above sense obviously less robust. The distributions D4 and D5 are comfortable for all room users only when they have the same climate preference. From experience, this is only the case, however, in the case of few room user distributions.

Figure 3:
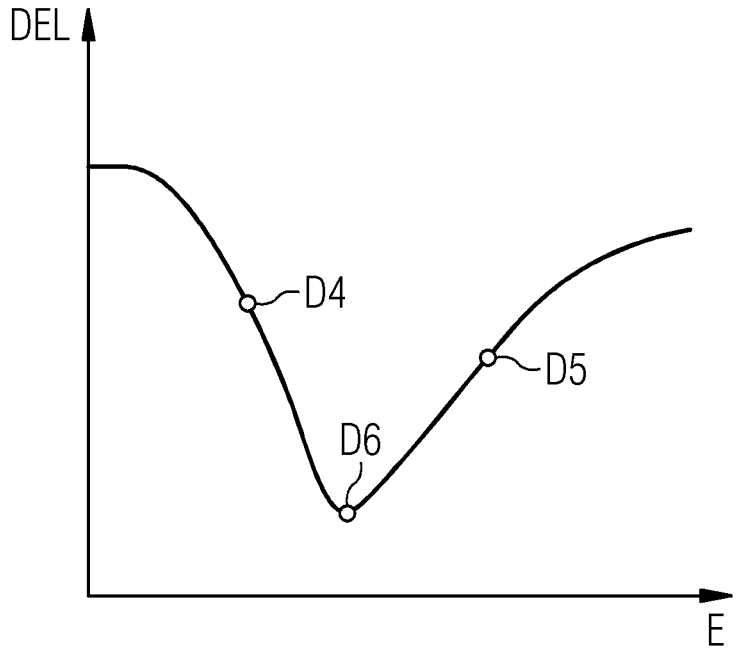
FIG. 3 shows a first graph illustrating a relationship between a fulfillment of climate preferences and an energy expenditure.
Figure 4:
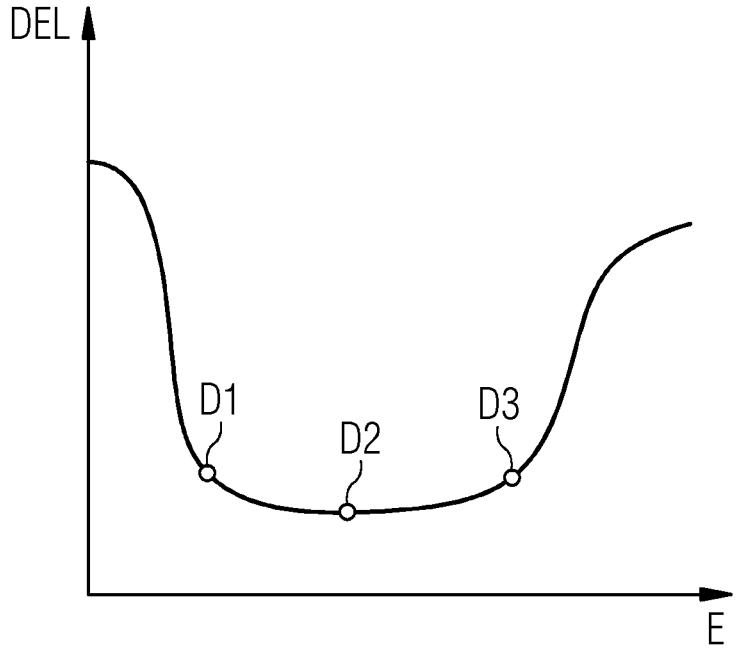
FIG. 4 shows a second graph illustrating a less sensitive relationship between a fulfillment of climate preferences and an energy expenditure.

FIGS. 3 and 4 illustrate, by way of example, in each case one relationship between an energy expenditure E and a resultant fulfillment of climate preferences of room users. The energy expenditure E can in this case be in particular a heating power. In the illustrated schematic graphs, in each case one discrepancy DEL between a simulated room climate and the climate preferences of the room users is plotted against the energy expenditure E. Insofar as a comfort of the room users reduces as the discrepancy DEL increases, as small as possible a discrepancy DEL needs to be sought in order to optimize comfort.

The first graph illustrated in FIG. 3 shows a course of the discrepancy DEL for room user distributions which have a higher sensitivity value, i.e., are less robust. In this case, the distributions D4, D5 and D6 are highlighted. The lesser robustness of the illustrated distributions is clear in FIG. 3 in particular from the fact that the minimum of the discrepancy DEL is relatively narrow. That is to say that already comparatively slight variations in the comfort-optimizing distribution D6 reduce comfort considerably.

In contrast, the second graph illustrated in FIG. 4 shows a course of the discrepancy DEL for room user distributions which have a lower sensitivity value, i.e., are more robust. In this case, the distributions D1, D2 and D3 are highlighted. The greater robustness of the illustrated distributions is clear in FIG. 4 in particular from the fact that the minimum of the discrepancy DEL is relatively wide. That is to say that variations in the comfort-optimizing distribution D2 reduce comfort comparatively little.

In order that the comfort in the case of changes in the influencing factors or in the case of newly arriving room users with other climate preferences is not reduced considerably or does not require an excessively high energy expenditure, in the present exemplary embodiment the both robust and energy-saving distribution D2 is selected. The room users are then distributed in accordance with the selected distribution D2, as described above, by individual position assignment indications POS in the room R.

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A computer-implemented method for comparing a room climate of a room with climate preferences of room users, wherein:

a) inputting the climate preferences of the room users;

b) detecting physical influencing factors on the room climate;

c) feeding the detected influencing factors into a simulator for simulating the room climate;

d) depending on the detected influencing factors, simulating, by the simulator, in each case one energy expenditure for an adaptation of the room climate to the climate preferences for different distributions of the room users in the room;

e) depending on the simulated energy expenditures, determining an energy-saving distribution of the room users; and f) in accordance with the energy-saving distribution, outputting position assignment indications for the room users.

2. The method as claimed in claim 1, wherein the room climate is brought close to the climate preferences of the room users distributed in accordance with the energy-saving distribution.

3. The method as claimed in claim 1, wherein the following are detected using sensors as the physical influencing factors:

a temperature, air humidity, a ventilation, a brightness, a shading or other room climate data of the room;

present, historical or predicted weather data;

a room utilization behavior; and/or a window position, a door position or a position of a shading installation.

4. The method as claimed in claim 1, wherein a digital building model for the room is input, and in that the energy expenditures are simulated on a basis of the digital building model.

5. The method as claimed in claim 4, wherein a semantic building model is input as digital building model, in that a building element type of the semantic building model is assigned to a building element type-specific simulator component, and in that the building element type-specific simulator component is initialized by an indication of the semantic building model on a building element of this building element type.

6. The method as claimed in claim 4, wherein the room or a building plan of the room is scanned, and in that, in dependence thereon, the digital building model is generated.

7. The method as claimed in claim 1, wherein a thermal image of the room is captured, and in that the simulator is calibrated by the thermal image.

8. The method as claimed in claim 1, wherein, for the simulation of a respective energy expenditure;

a discrepancy between a simulated room climate and the climate preferences of the room users distributed in accordance with a respective distribution is determined; and the energy expenditure for the adaptation of the room climate which reduces or minimizes the discrepancy is determined.

9. The method as claimed in claim 1, wherein the energy expenditures for variations in the climate preferences and/or the influencing factors are simulated, in that in each case one sensitivity value which quantifies a variation in the energy expenditures in the case of a variation in the climate preferences and/or the influencing factors is determined for the distributions of the room users, and in that the energy-saving distribution is determined depending on the determined sensitivity values.

10. The method as claimed in claim 1, wherein a fluctuation indication on a fluctuation to be expected in an occupancy of the room by the room users is input, and in that the energy-saving distribution is determined depending on the fluctuation indication.

11. The method as claimed in claim 1, wherein a present occupancy of the room by the room users is detected, in that the energy-saving distribution is determined depending on the present occupancy.

12. An arrangement for comparing a room climate of a room with climate preferences of room users, the arrangement comprising:

one or more processors configured for implementing a method as claimed in claim 1.

13. A computer program product, comprising a computer readable hardware storage device having computer readable program code stored therein, said program code executable by a processor of a computer system to implement a method as claimed in claim 1.

14. A non-transitory computer-readable storage medium having a stored computer program product as claimed in claim 13.

15. The method as claimed in claim 1, further comprising:

g) actuating a closed-loop control system for the room climate in accordance with the energy-saving distribution.

16. The method as claimed in claim 15, wherein the closed-loop control system comprises a heating system, an air-conditioning system, a ventilation system, and/or a shading device.

* * * * *